US006591849B1

(12) United States Patent
Swetish et al.

(10) Patent No.: US 6,591,849 B1
(45) Date of Patent: Jul. 15, 2003

(54) FOLDABLE FRAME STRUCTURE

(76) Inventors: Thomas R. Swetish, 464 Melvin Ave., Racine, WI (US) 53402; William R. Baumann, 16130 W. Armour Ave., New Berlin, WI (US) 53151

( * ) Notice: Subject to any disclaimer, the term of this patent is extended or adjusted under 35 U.S.C. 154(b) by 0 days.

(21) Appl. No.: 09/598,822

(22) Filed: Jun. 21, 2000

(51) Int. Cl.[7] ..... E04H 15/46

(52) U.S. Cl. ..... 135/140; 135/144; 135/152; 135/153; 135/123; 403/119

(58) Field of Search ..... 135/139, 140, 135/141, 142, 143, 144, 145, 146, 151, 152, 153, 114, 123; 403/171, 119; 211/195, 199, 105; 52/646, 645

(56) References Cited

U.S. PATENT DOCUMENTS

| | | | | | |
|---|---|---|---|---|---|
| 1,318,192 | A | * | 10/1919 | Wetzel | 52/646 |
| 2,723,673 | A | * | 11/1955 | Call | 135/151 |
| 3,469,588 | A | * | 9/1969 | Rainwater | 52/152 |
| 4,029,211 | A | * | 6/1977 | Marshall | 211/104 |
| 4,473,986 | A | * | 10/1984 | Zeigler | 403/171 X |
| 4,607,656 | A | | 8/1986 | Carter | |
| 4,630,627 | A | | 12/1986 | Windows et al. | |
| 4,641,676 | A | | 2/1987 | Lynch | |
| 4,779,635 | A | | 10/1988 | Lynch | |
| 4,809,725 | A | * | 3/1989 | Champigny | 135/75 |
| 4,846,204 | A | * | 7/1989 | Sok Kyu | 135/147 X |
| 4,885,891 | A | | 12/1989 | Lynch | |
| 4,945,936 | A | | 8/1990 | Surrendi | |
| 5,035,253 | A | | 7/1991 | Bortles | |
| 5,197,503 | A | * | 3/1993 | Chen | 135/97 |
| 5,274,980 | A | * | 1/1994 | Zeigler | 135/147 X |
| 5,361,794 | A | * | 11/1994 | Brady | 135/147 |
| 5,450,703 | A | | 9/1995 | Fuhrman et al. | |
| 5,485,863 | A | | 1/1996 | Carter | |
| 5,634,483 | A | | 6/1997 | Gwin | |
| 5,671,766 | A | * | 9/1997 | Williams | 135/143 |
| 5,701,713 | A | * | 12/1997 | Silver | 52/645 |
| 5,701,923 | A | | 12/1997 | Losi, Jr. et al. | |
| 5,813,425 | A | | 9/1998 | Carter | |
| 5,842,685 | A | * | 12/1998 | Purvis et al. | 256/67 |
| 6,000,175 | A | * | 12/1999 | Gale et al. | 135/127 X |
| 6,089,247 | A | * | 7/2000 | Price | 135/145 |
| 6,269,825 | B1 | * | 8/2001 | Yager | 135/120.1 |

FOREIGN PATENT DOCUMENTS

| | | | | |
|---|---|---|---|---|
| GB | 2200152 | * | 7/1988 | 135/143 |

* cited by examiner

*Primary Examiner*—Lanna Mai
*Assistant Examiner*—Dinnie Yip

(57) ABSTRACT

A portable shelter is disclosed. The portable shelter includes a canopy and a frame supporting the canopy. The frame of the portable shelter includes a plurality of support poles and a plurality of cross poles. Each cross pole of the portable shelter is pivotally coupled between adjacent support poles for rotation about an axis parallel to the support poles. Each support pole moves between an extended position in which the support pole extends perpendicular to the cross poles and a collapsed position in which the support pole extends along the cross poles.

33 Claims, 6 Drawing Sheets

FIG. 3
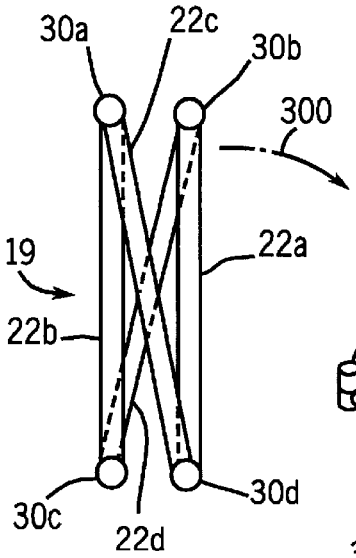
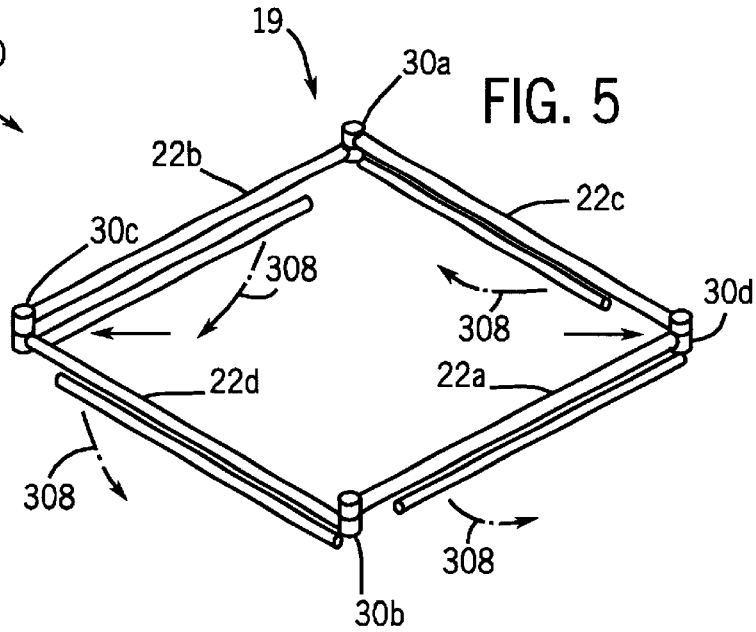
FIG. 5
FIG. 4
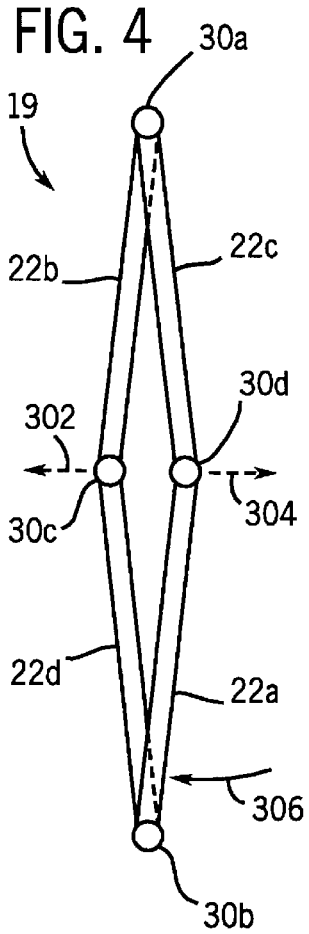
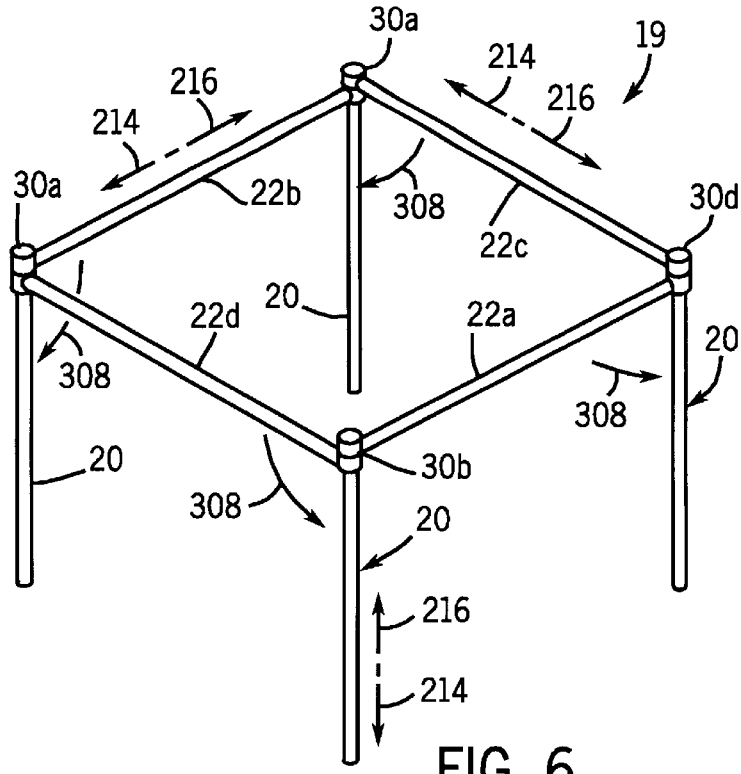
FIG. 6

FOLDABLE FRAME STRUCTURE

FIELD OF THE INVENTION

The present invention relates to foldable canopy structures that collapse into readily portable units. In particular, the present invention relates to a foldable unit that provides a simplified structure having a plurality of pivotal joints, each pivotal joint being coupled to two cross poles and releasably connected to a support pole enabling the foldable structure to be easily and simplistically expanded.

BACKGROUND OF THE INVENTION

Foldable canopy structures that collapse into a readily portable unit are well known in the outdoor products industry. Such canopy structures are generally used to protect users from the rain or sun for a wide variety of activities. The benefit of these foldable structures is that while the structure covers a large area when expanded, once collapsed it is small enough to be readily transported and stored. Recent advances in collapsible structures have made them both lighter and easier to assemble.

While portable shelters have undergone several recent advances, current shelters continue to have several deficiencies. One of the major drawbacks of existing structures is that to achieve a readily collapsible frame, existing structures are complex. Many of these structures heavily rely on complicated elements such as scissor joints. Additionally, the structures require complicated folding arrangements, detailed configurations and numerous elements. The complexity of the systems limits the ease of use for such structures.

The complexity of the current collapsible systems also adds weight to the structures. The result is that weight becomes a factor with even the lightest of existing systems. The additional weight makes the structures more difficult to collapse. Additionally once the structure is collapsed the structures are more difficult to move. This compromises many of the potential benefits of portability.

Another drawback of existing structures is that the complexity and the mechanics of the structures require a two-person set-up. While existing structures do offer some conveniences, the two-person set-up requirement limits both the ease of consumer use and the gamete of practical uses for these shelters.

As a result, there is a continuing need for a foldable and portable canopy structure that provides a simplified structure, that eliminates the need for a two-person set-up, and that provides a lighter structure that will facilitate set-up, take-down, and portability.

SUMMARY OF THE INVENTION

The present invention relates to foldable canopy structures that collapse into readily portable units. In particular, the present invention relates to a foldable unit that provides a simplified structure having a plurality of pivotal joints, each pivotal joint being coupled to two cross poles and releasably connected to a support pole enabling the foldable structure to be easily and simplistically expanded.

In accordance with one aspect of the present invention, the foldable structure consists of a frame. The frame includes a plurality of support poles and a plurality of cross poles. Each cross pole is pivotally coupled between adjacent support poles for rotation about an axis parallel to the support poles.

In accordance with yet another aspect of the present invention, the frame structure includes a plurality of support poles and a plurality of cross poles. Each support pole includes a first section and a second section telescopically receiving the first section. Each support pole is flexibly coupled to adjacent cross poles for folding about an axis parallel to the cross poles. Each cross pole includes a first section and a second section telescopically receiving the first section. Each cross pole is pivotally coupled between adjacent support poles for rotation about an axis parallel to the support poles.

The present invention also provides a foldable frame. The foldable frame includes a plurality of cross poles and a plurality of movable support poles. A plurality of cross poles are pivotally coupled to one another. Each support pole is configured to move between a first position in which the support pole extends parallel to one of the plurality of cross poles and a second position in which the support pole extends perpendicular to one of the plurality of cross poles.

The present invention also provides a method for setting up a portable shelter. The method includes providing a frame having a plurality of cross poles and a plurality of support poles in a collapsed state. In the collapsed state, the plurality of cross poles includes a first cross pole having a first end and a second end, a second cross pole extending substantially parallel to the first cross pole and having a first end and a second end, a third cross pole having a first end pivotally coupled to the first end of the first cross pole and a second end pivotally coupled to the second end of the second cross pole, and a fourth cross pole crossing the third cross pole and having a first end pivotally coupled to the first end of the second cross pole and a second end pivotally coupled to the second end of the first cross pole. The plurality of support poles includes a first support pole extending substantially parallel to the first cross pole, a second support pole extending substantially parallel to the second cross pole, a third support pole extending substantially parallel to the third cross pole and a fourth support pole extending substantially parallel to the fourth cross pole. The method also includes the steps of pivoting the plurality of cross poles to a rectangular position wherein the first and second cross poles extend parallel to one another and wherein the third and fourth cross poles extend parallel to one another. The plurality of support poles are also pivoted to a supporting position. In the supporting position, each support pole extends perpendicular to the plurality of cross poles.

The present invention also provides an apparatus for supporting a canopy. The apparatus includes a frame having a plurality of cross poles and a plurality of support poles in a collapsed state. In the collapsed state, the plurality of cross poles includes a first cross pole having a first end and a second end, a second cross pole extending substantially parallel to the first cross pole and having a first end and a second end, a third cross pole having a first end pivotally coupled to the first end of the first cross pole and a second end pivotally coupled to the second end of the second cross pole, and a fourth cross pole crossing the third cross pole and having a first end pivotally coupled to the first end of the second cross pole and a second end pivotally coupled to the second end of the first cross pole. The plurality of support poles includes a first support pole extending substantially parallel to the first cross pole, a second support pole extending substantially parallel to the second cross pole, a third support pole extending substantially parallel to the third cross pole and a fourth support pole extending substantially parallel to the fourth cross pole. The plurality of cross poles pivot to a rectangular position such that the first and second cross poles extend parallel to one another and such that the third and fourth cross poles extend parallel to one another. The plurality of support poles are movable to a supporting position such that each support pole extends perpendicular to the plurality of cross poles.

BRIEF DESCRIPTION OF THE DRAWINGS

FIG. 3 is a schematic view of the foldable frame structure FIG. 1 illustrating the structure in a collapsed state.

FIG. 4 is a schematic view of the foldable frame structure of FIG. 1 illustrating the structure during a first opening phase.

FIG. 5 is a schematic view of the foldable frame structure of FIG. 1 illustrating the structure during a second opening phase.

FIG. 6 is a schematic view of the foldable frame structure of FIG. 1 illustrating the structure during a third opening phase.

DETAILED DESCRIPTION OF THE PREFERRED EMBODIMENTS

I. OVERVIEW

Figure 1:
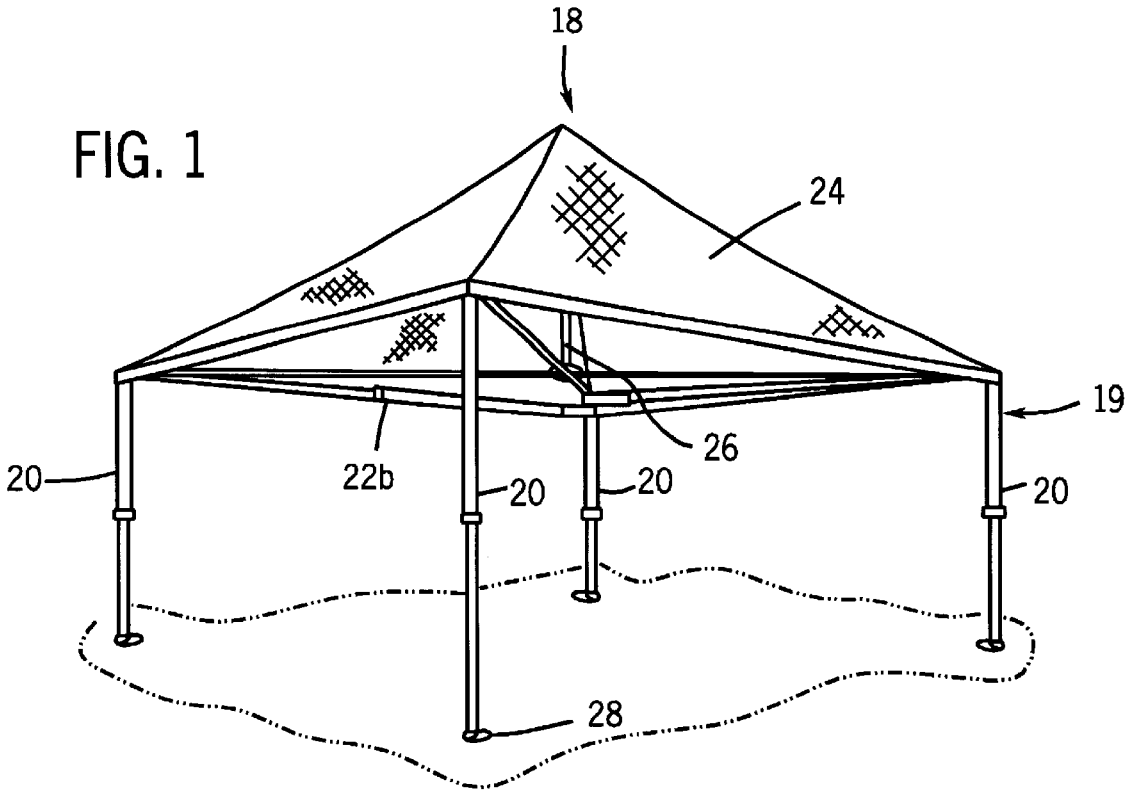
FIG. 1 is a perspective view of a foldable frame structure in an expanded state and including a canopy cover and canopy support structure.
Figure 2:
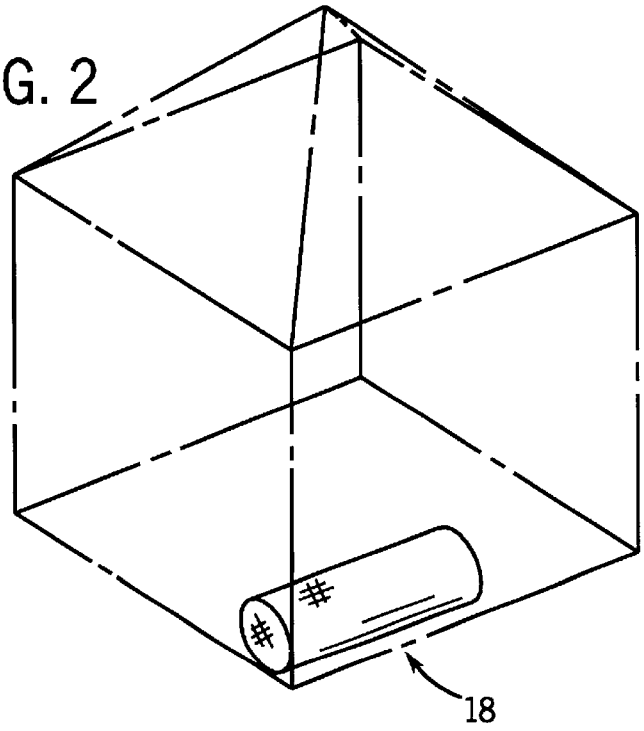
FIG. 2 is a perspective view of the foldable frame structure of FIG. 1 in a collapsed mode illustrating the relative size difference in collapsed and expanded state.

FIGS. 1 and 2 are perspective views of a foldable frame structure 19. FIG. 1 is a perspective view of the foldable canopy 18 including foldable frame structure 19 comprising a plurality of support poles 20 and a plurality of cross poles 22. FIG. 2 illustrates the foldable frame structure 19 in collapsed mode.

As shown in FIG. 1, foldable canopy 18 includes a canopy cover 24, a canopy support tension system 26, and a foldable frame structure 19. The canopy cover 24 is attached to the foldable frame structure 19. Such canopy covers 24 are conventionally known in the art and provide shelter from the elements. Canopy cover 24 can be made from a variety of suitable material including plastic tarpaulins, natural fibrous based materials, nylon, or other light weight materials commonly used as coverings in outdoor canopies and tents. Canopy tension system 26 is commonly known and provides support to the canopy cover 24.

Foldable frame structure 19 comprises a plurality of cross poles 22, a plurality of support poles 20 and a plurality of clamping feet 28. The cross poles 22 are coupled together by pivotal joints 30*a*, 30*b*, 30*c*, and 30*d* (FIG. 3). Cross poles 22 supply a perimeter frame structure to the foldable canopy 18. The cross poles 22 preferably comprise a conventionally known support tubing or poles such as hollow aluminum or plastic tubing or alternatively any one of a variety of other flexible or inflexible material suitable for a frame structure.

Figure 10:
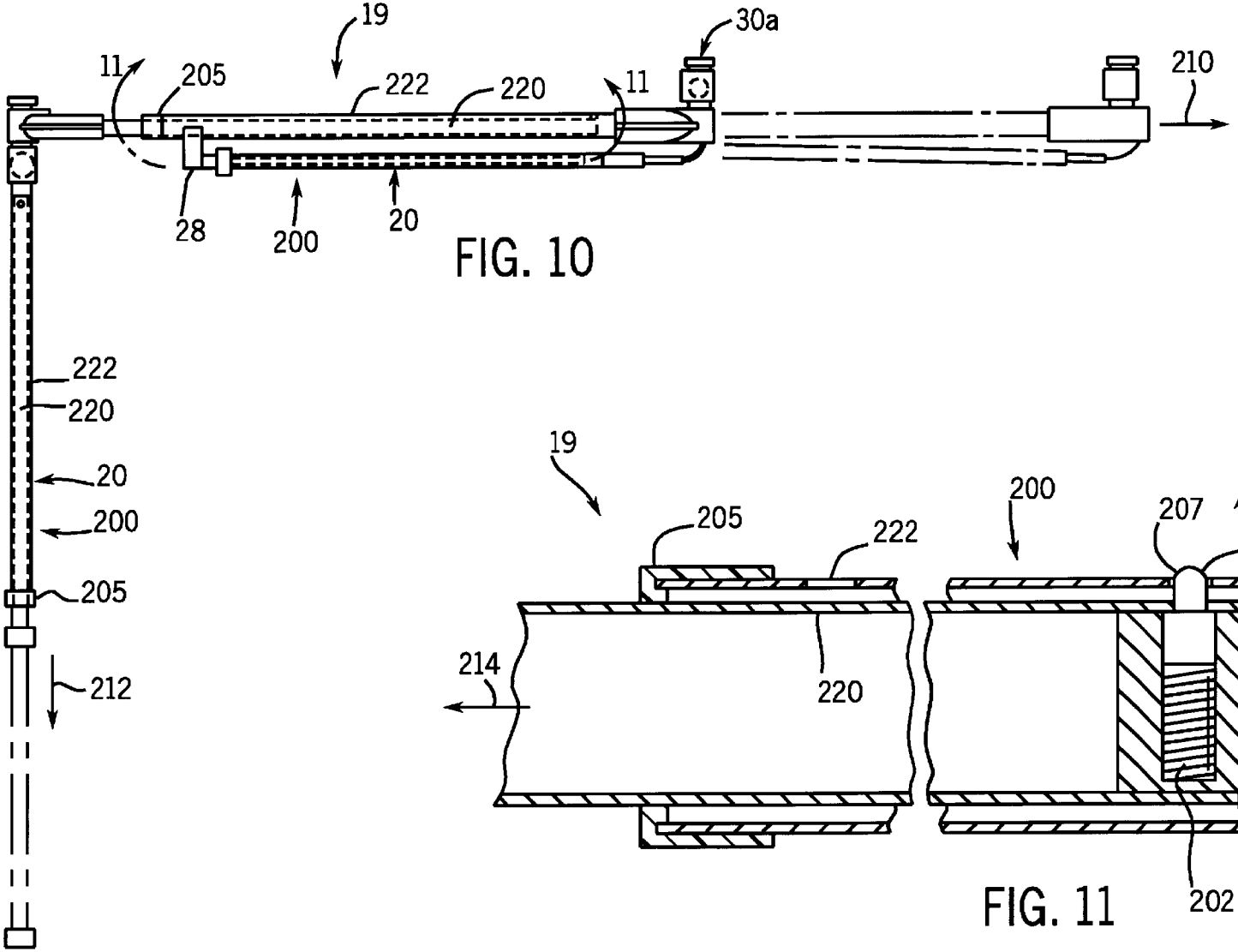
FIG. 10 is a perspective view of the cross pole and the support pole illustrating a telescoping feature of the cross pole and support pole.

The support poles 20 are selectively coupled to the cross poles 22 by pivotal joints 30*a*, 30*b*, 30*c* and 30*d* (FIG. 3). The support poles 20 provide vertical support to the canopy structure 18. The support poles 20 are foldable in order to collapse the structure 19 (FIGS. 5 and 10). The support poles 20 preferably comprise a conventionally known support tubing or poles such as hollow aluminum or plastic tubing or alternatively any one of a variety of other flexible or inflexible material suitable for a frame structure.

Clamping feet 28 are attached to the base of support poles 20. Feet 28 provide a means for both stabilizing the support poles 20 and for coupling the support poles 20 to the cross poles 22 when folded (See FIG. 14).

As shown by FIG. 2, canopy 18 or alternatively foldable frame structure 19 is collapsible providing a relative size advantage over the expanded structure 19 for transportation and storage.

FIGS. 3–6 are schematic views illustrating the foldable frame structure 19 of FIG. 1 being converted from the collapsed state to the expanded state. FIG. 3 illustrates the foldable frame structure 19 in the collapsed state in greater detail including pivotal joint 30*a* and a plurality of cross poles 20. As shown by FIG. 3, pivotal joints 30*a*, 30*b*, 30*c*, 30*d* allow cross poles 22 to be rotated so that in a collapsed state the cross poles 22*a* and 22*b* are parallel while cross poles 22*c* and 22*d* cross one another in an X fashion. This allows foldable frame structure 19 to be collapsed to the length of a single cross pole 22 and the width of approximately two times the girth of a cross pole 22 while in the collapsed state.

FIG. 4 illustrates structure 19 in the first opening phase necessary to expand the structure 19. Foldable frame structure 19 rotates from collapsed mode or state (FIG. 3) about the axes of pivotal joints 30*c* and 30*d* allowing the terminus of pivotal joint 30*b* to be moved in the direction of arrow 300. As pivotal joint 30*b* finishes the rotation in the direction indicated by arrow 306, it moves from being adjacent to pivotal joint 30*a* (FIG. 3) to the end of the structure 19 opposite pivotal joint 30*a* (FIG. 4). As shown in FIG. 4, the cross bars 22 are positioned such that pole 22*b* is adjacent to pole 22*c* and pole 22*d* is adjacent to pole 22*a* in the first opening phase.

FIG. 5 illustrates structure 19 in the second opening phase with cross poles 22 extended to an open position. The second opening phase is accomplished by extending pivotal joint 30*c* laterally in the direction of arrow 302 and joint 30*d* laterally in the direction of arrow 304. Pivotal joints 30*a* and 30*d* contain an angle restriction mechanism 110 (see FIG. 11) preventing extension of 30*a* and 30*d* further than the angle necessary to accomplish a rectangular frame formation. Angle restriction mechanism 110 also prevents foldable frame structure 19 from being folded improperly by allowing only pivotal joint 30*b* to rotate the 270 degree angle necessary to accomplish folded configuration as shown FIG. 3.

FIG. 6 illustrates structure 19 in the third opening phase with support poles 20 extended. The third opening phase is accomplished by unfolding support poles 20, as shown by arrows 308, to the vertical position from the folded position where support poles 20 are clamped to cross poles 22. In the preferred embodiment, support poles 20 mate with the pivotal joints 30*a*, 30*b*, 30*c*, and 30*d*. By accepting and internally receiving support poles 20, pivotal 30*a*, 30*b*, 30*c*, and 30*d* lend stability to the frame structure 19. In the third opening phase, support poles 20 and cross poles 22 are telescopically extended along arrows 214 and 216 to expand the size of frame structure 19.

In the preferred embodiment, the telescopic mechanism 220 consists of sliding sections which allow the poles 20 and 22 to be elongated. In an alternative embodiment, the telescopic mechanism 220 is replaced with hinges which allow the poles 20 to be elongated.

In one embodiment of the present invention, the foldable frame 19 includes four cross poles 22 joined to form a rectangular perimeter. In alternative embodiments, the foldable frame 19 includes varying numbers of cross poles 22 joined to form perimeters having linear segments, such as triangles, octagons, etc.

The benefit of foldable structure 19 stems from the simplicity of the structure, and the straightforward set-up and take-down. To unfold structure 19, first the user rotates the end of pivotal joint 30*b* to the opposite end of the structure. Second, the user opens the perimeter of the structure 19 by extending joints 30*c* and 30*d* laterally. Thirdly, the user unfolds support poles 20. Lastly, user extends telescopic mechanisms 200 (see FIG. 10) of support poles 20 and cross poles 22.

II. PIVOTAL JOINT

Figure 7:
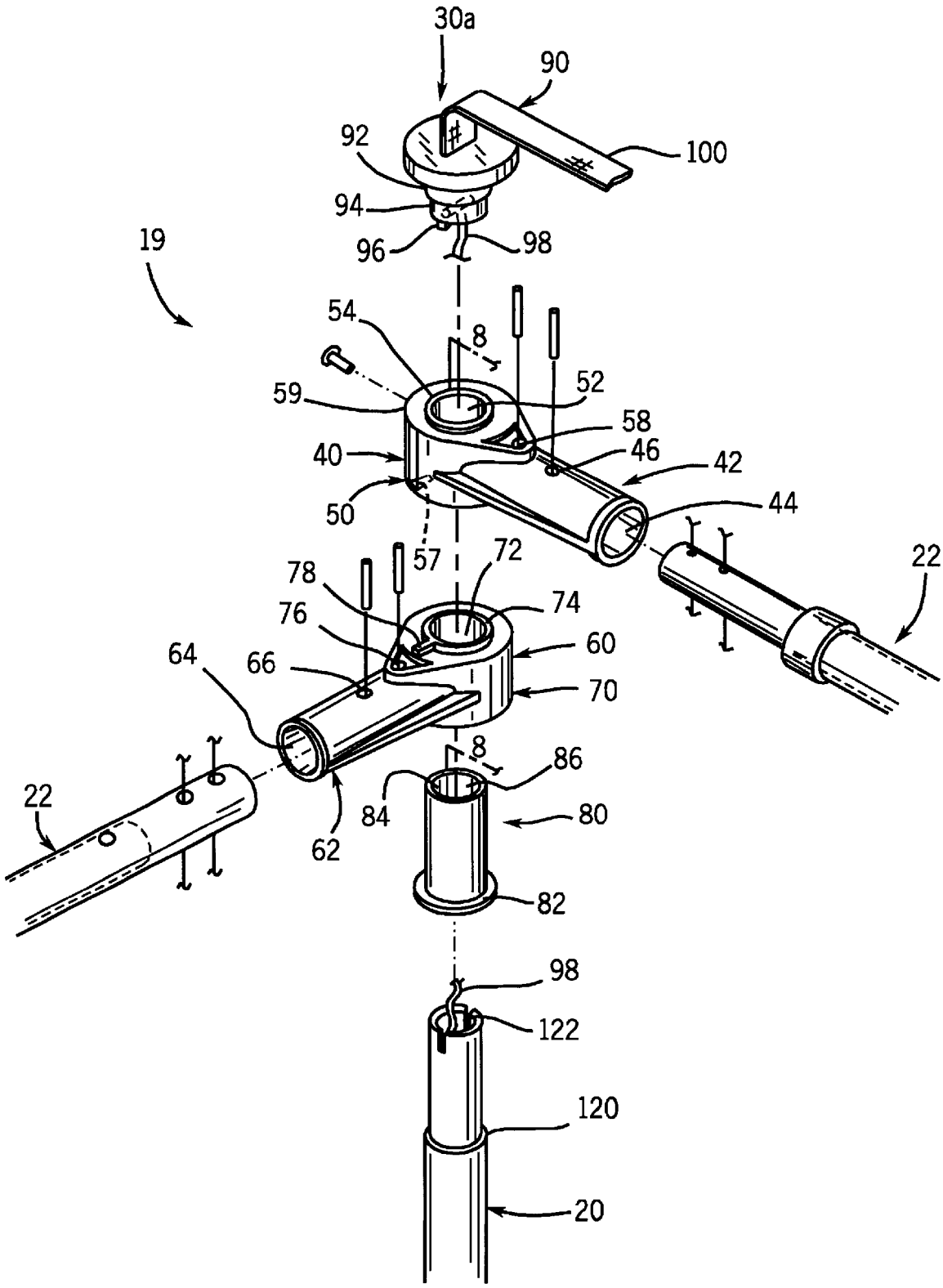
FIG. 7 is a fragmentary exploded view of a pivotal joint assembly of the foldable frame structure.
Figure 8:
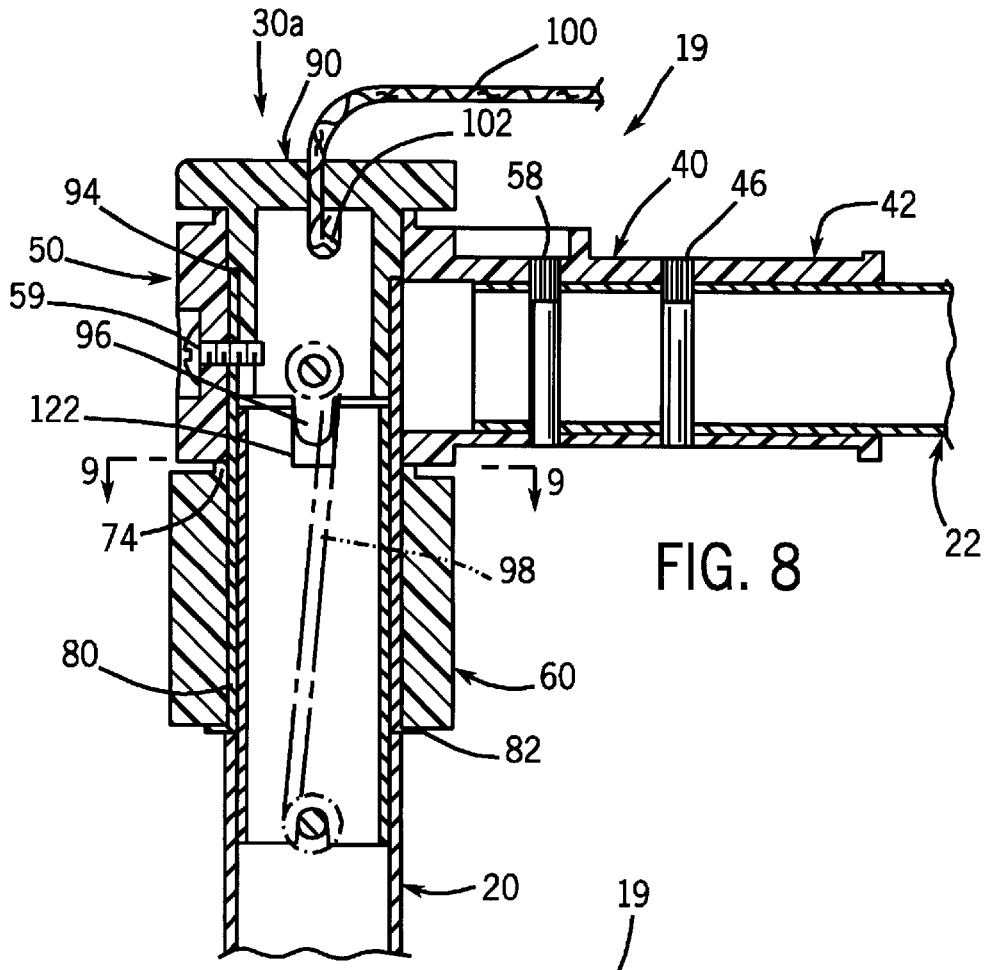
FIG. 8 is a sectional view of the pivotal joint of FIG. 7 taken along lines 8—8 illustrating a cross pole and a support pole coupled to the pivotal joint.
Figure 9:
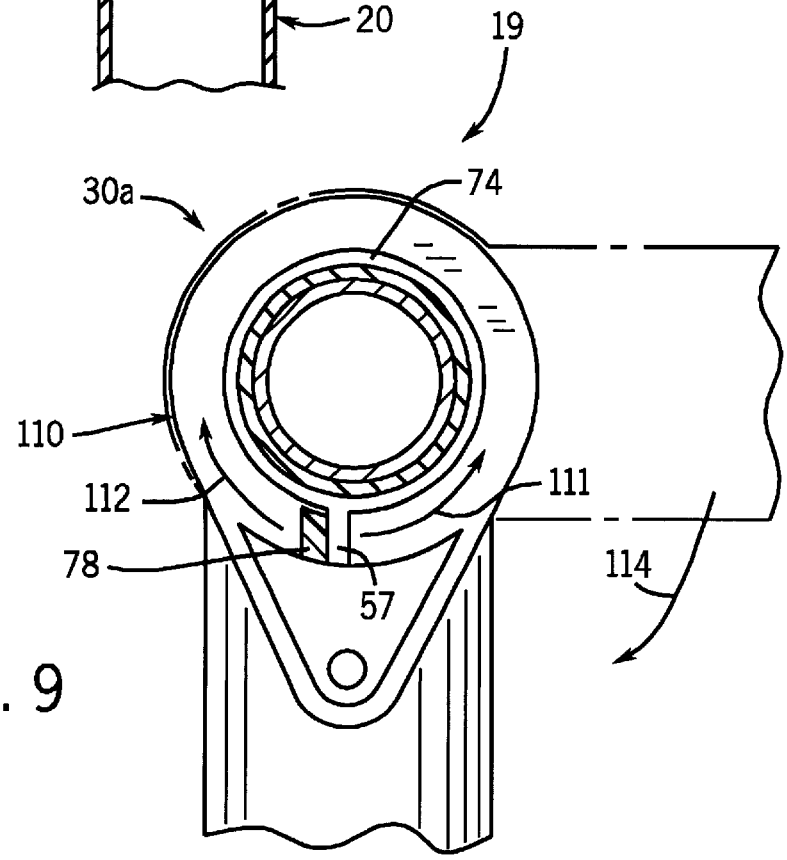
FIG. 9 is a sectional view of the pivotal joint of FIG. 8 taken along lines 9—9.

FIGS. 7–9 illustrate pivotal joint 30*a* in greater detail. In particular, FIG. 7 is a fragmentary exploded view of the pivotal joint 30*a*. FIG. 8 is a cross-sectional view of pivotal joint 30*a* illustrating support pole 20 and cross pole 22 coupled to pivotal joint 30*a*. FIG. 9 is a sectional view of pivotal joint 30*a* illustrating an angle restriction mechanism 110. Pivotal joint 30*d* is substantially identical to pivotal joint 30*a*. Pivotal joints 30*b* and 30*c* are substantially identical to pivotal joint 30*a* except that joints 30*b* and 30*c* omit an angle restriction mechanism described hereafter. As shown by FIG. 7, pivotal joint 30*a* generally includes a first joint module 40, a second joint module 60, a joint cap 90, and a joint base bushing 80. First joint module 40 comprises a generally rigid housing or casing having an anterior end 42 and a second posterior end 50. Anterior end 42 has a horizontal interior portion 44 to support cross pole 22 and a top bore 46 for inserting a pin, screw, or other fastener to secure cross pole 22. Posterior end 50 has a vertical interior portion 52, a top perimeter lip 54, a top bore 58, a outward blocking projection 57, and a rear horizontal bore 59. Vertical interior portion 52 receives joint base bushing 80 and joint cap 90. Perimeter lip 74 provides separation between first joint module 40 and joint cap 90 reducing friction during rotation. Top bore 58 allows insertion of a pin, screw, or other fastener additionally securing cross pole 22. Rear horizontal bore 59 allows insertion of a pin, screw, or other fastener to secure joint cap 90 and joint base bushing 80 coupling the pivotal joint components to form the pivotal joint 30*a*. Outward blocking projection 57 functions as a component of angle restriction mechanism 110 (FIG. 9).

As shown in FIG. 7, the second joint module 60, like first joint module 40, comprises a generally rigid housing or casing having an anterior end 62 and a second posterior end 70. Anterior end 62 has a horizontal interior portion 64 to define or support cross pole 22 and a top bore 66 for inserting a pin, screw, or other fastener to secure cross pole 22. Posterior end 70 has a vertical interior portion 72, a top perimeter lip 74, and a top bore 76. Vertical interior portion 72 accepts joint base bushing 80. Perimeter lip 74 includes a lip projection 78 that operates as component of angle restriction mechanism 110. Perimeter lip 74 provides separation between first joint module 40 and second joint module 60 reducing friction during rotation and allowing for rotation of outward blocking projection 57. Top bore 76 allows insertion of a pin, screw, or other fastener additionally securing cross pole 22.

Joint base bushing 80 is an elongate cylinder to be fitted to vertical interior portion 72 of first joint module 40 and vertical interior portion 52 of second joint module 60. Bushing 80 provides a smooth cylinder to accept support pole 20. Bushing 80 includes a retention flange 82, lateral base bushing bore 84, and bushing vertical interior 86. Retention flange 82 facilitates assembly, retains second joint module 60, and provides a butting for ridge 120 on support pole 20. Lateral base bushing bore 59 aligns with rear horizontal bore 59 to allow for insertion of pin, screw, or other connecting means to couple components of pivotal joints 30*a*, 30*b*, 30*c*, and 30*d* to form pivotal joints 30*a*, 30*b*, 30*c*, and 30*d*. Bushing vertical interior 86 accepts support pole 20 when pole 20 is in an unfolded state.

Joint cap 90 is a rigid or solid member coupled to first joint module 50 and joint base bushing 80. As shown in FIG. 7, joint cap 90 includes rear cap bore 92, declinating ridge 94, a bottom projection 96, and an interior tension cord 98. Rear cap bore 92 aligns with rear horizontal bore 59 to allow for insertion of pin, screw, or other connecting means to couple cap to pivotal joint 30. When coupled to first joint module 40, declinating ridge 94 defines an internal boundary to delineate a void to accept joint base bushing 80. Bottom projection 96 inserts into support pole notch 122 to limit rotation when support pole 22*a*, 22*b*, 22*c*, 22*d* are coupled to pivotal joints 30*a*, 30*b*, 30*c*, and 30*d*. In the preferred embodiment, interior tension cord 98 comprises an elastic cord coupled between the support pole 20 and cap 90. Tension cord 98 allows the support poles 20 to be selectively inserted and removed from pivotal joints 30*a*, 30*b*, 30*c*, and 30*d* while remaining attached to pivotal joints 30*a*, 30*b*, 30*c*, and 30*d*. Additionally, tension cord 98 facilitates guidance of support pole 20 into the internal aperture 86 of the pivotal joints 30*a*, 30*b*, 30*c*, and 30*d* defined by joint base bushing 80. In an alternative embodiment, elastic tension cord 98 is replaced with other inelastic material. In another embodiment elastic tension cord is replaced with a hinge, rod, or other mechanism which allows the support poles 20 to be folded while maintaining connection with pivotal joints 30*a*, 30*b*, 30*c*, and 30*d*. In another embodiment, a coupling means such as a tension cord 98 or hinge is absent altogether.

FIG. 8 illustrates bottom projection 96 inserted into support pole notch 122 in greater detail. Pivotal joint 30*a* is coupled with cross poles 22 by a pair of screws, pins, or other attachment means inserted through bores 46 and 58. Joint cap 90 is attached to first joint module 50, second joint module 60, and joint base bushing 80 by tension core 98. As a result, cord 98 is easily serviced. Alternatively, joint cap 90 may be secured to module 50 by means of a screw, pin, or other attachment mechanism through rear horizontal bore 59 and joint base bore 84. Retaining flange 82 retains second joint module 60 to the rest of pivotal joint 30. Tension cord 98 is coupled internally to joint cap 90 and support pole 20.

As shown in FIG. 9, pivotal joint 30*a* includes internal angle restriction mechanism 110. Angle restriction mechanism 110 includes outward blocking projection 57 extending from base of first joint module 40 and a lip projection 78 extending from perimeter lip 74 of second joint module 60. Projections 57 and 78 oppose one another to restrict rotation of pivotal joints 30*a* and 30*d* (shown in FIG. 3) to given angles. When projections 57 and 78 are not touching, pivotal joints 30*a* and 30*d* may rotate such that projection 78 may move in the direction of either arrow 111 or 112 with respect to projection 57. Once the projections 57 and 78 butt, the joints can only rotate such that projection 78 moves in the direction indicated by arrow 112 with respect to projection 57. The angle restriction mechanism 110 facilitates both folding and expansion of foldable frame structure 19. By restricting the range of rotation in the pivotal joints 30*a* and 30*d*, the angle restriction mechanism ensures that the frame 19 will fold properly. Similarly, by restricting the scope of rotation in the pivotal joints 30*a* and 30*d*, the angle restriction mechanism stops rotation of the joints 30*a* and 30*d* when it is extended in the open state shown in FIG. 5. This lends stability to structure 19 by preventing excessive rotation of joints 30 when in an open state, thus helping to maintain a proper perimeter frame shape. In the embodiment of foldable frame structure 19 which includes four cross poles 22 so as to form a rectangle, angle restriction mechanism restricts joints at 90 degree angles when opened.

Pivot joints 30*b* and 30*c* rotate freely relative to one another. In the exemplary embodiment, joint modules 40 and 60 of pivotal joints 30*b* and 30*c* omit projections 57 and 78 such that modules 40 and 60 freely rotate relative to one another. In an alternative embodiment, module 60 includes a vertically extending bore and a removable metal pin in lieu of projection 78. In pivotal joints 30*a* and 30*d*, the pin is inserted through the bore and projects between modules 40 and 60 to engage projection 78 and to limit angular rotation of module 40 relative to module 60. In pivotal joints 30*b* and 30*c*, the pin is simply removed such that modules 40 and 60 may freely rotate relative to one another. In yet another alternative embodiment, modules 40 and 60 are simply reversed in pivotal joints 30*b* and 30*c* such that projection 57 extends along a top of module 40, such that projection 78 extends along a bottom of module 60 and such that projections 57 and 78 are out of engagement with one another to enable free relative rotation.

III. TELESCOPIC MECHANISM

Figure 11:
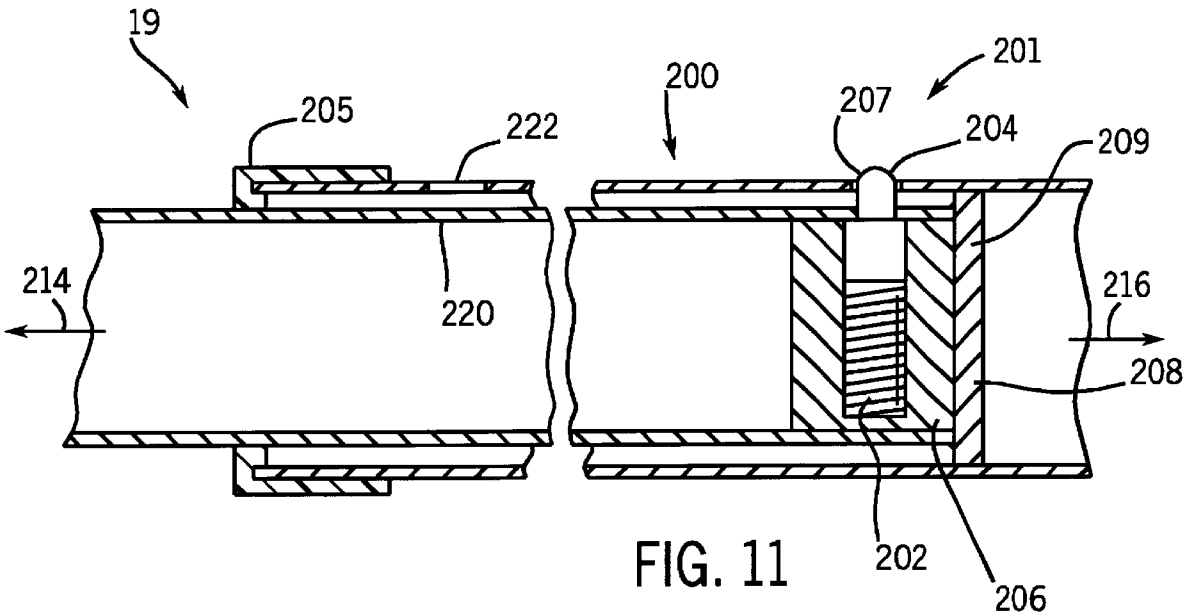
FIG. 11 is a sectional view of the shelter of FIG. 10 taken along lines 11—11.

FIG. 10 further illustrate cross poles 22 and support poles 20 including telescopic mechanism 200 which permits the poles 20 and 22 to be extended to increase the size of foldable frame structure 19 when in the expanded state. FIG. 11 illustrates telescoping mechanism 200 in greater detail including detent mechanism 201. As shown by FIG. 10, cross poles 22 and support poles 20 include telescopic mechanism 200 which permits poles 20 and 22 to be extended.

As best shown by FIG. 11, telescopic mechanism 200 includes a first section 220, a second section 222, detent mechanism 201, a telescopic bushing 208, and a telescopic retention flange 205. The first section 220 fits inside the second section 222. This allows first section 220 and second section 222 to be selectively extended with first section 220 moving in the direction of arrow 214 and second section 222 in the direction of arrow 216. By moving sections 220 and 222 in the opposite direction of arrows 214 and 216, the telescopic feature 200 is collapsed. Telescopic bushing 208 eliminates direct contact of the first section 220 and the second section 222 when sections are being extended or retracted, reducing frictional resistance on the sections 220 and 222. Telescopic bushing 208 is coupled to section 220 and includes a bushing lip 209. Telescopic retention flange 205 is coupled to section 222. Flange 205 further eliminates direct contact of first section 220 and the second section 222 when section are being extended or retracted, reducing frictional resistance on the section 220 and 222. Flange 205 also prevents bushing lip 209 from passing, preventing the first section 220 and the second section 222 from being separated during extension.

Detent mechanism 201 includes a pin 204, a pin spring 202, a pin base 206, and a detent 207. Pin base 206 is integrally formed with cap 208. Pin base 206 contains pin spring 202 and pin 204 in the interior of the first section 220. Pin spring 202 exerts outward force on the pin 204. Pin 204 extends through detent 207 locking the telescopic mechanism 200 in one or more positions.

IV. CANOPY SUPPORT TENSION SYSTEM

Figure 12:
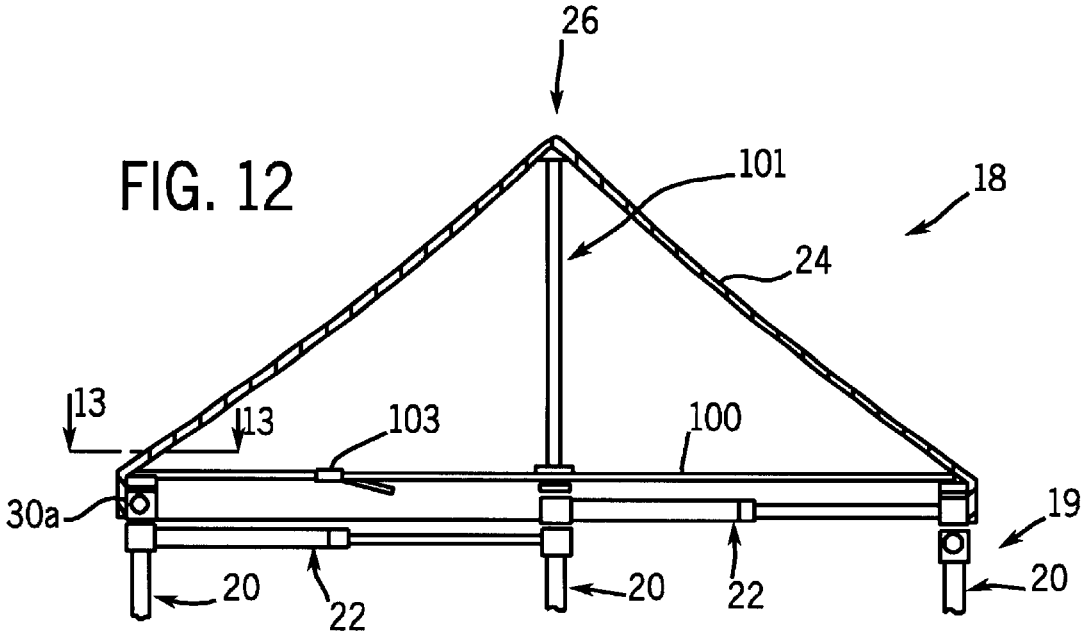
FIG. 12 is a sectional view of the foldable frame structure of FIG. 1.
Figure 13:
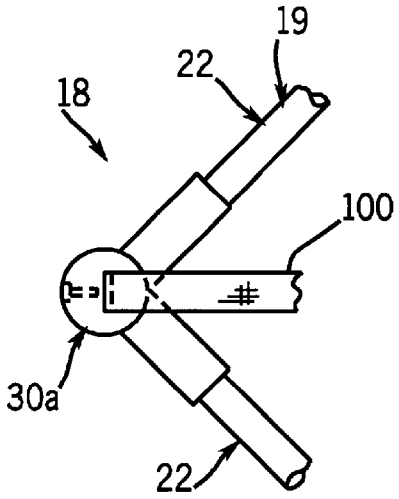
FIG. 13 is an enlarged fragmentary sectional view of the shelter of FIG. 12 taken along lines 13—13.

FIGS. 12 and 13 illustrate canopy support tension system 26. Canopy support tension system 26 includes support pole 101 and support straps 100. As shown in FIG. 13, support straps 100 are coupled to pivotal joint 30*a*. FIG. 8 illustrates one embodiment of the coupling of joint 30*a* and strap 100 in better detail. The support strap 100 is integrated into the joint cap 90 with an internal pin or dowel 102. In alternative embodiments support strap 100 is integrated into joint cap 90 by a clamp or other mechanism. In another alternative embodiment, support strap 100 is integrated to other portions of the pivotal joint 30*a*. Support pole 101 is coupled at the base to support straps 100. Support pole 101 provides internal support to canopy 24 when the foldable frame structure 19 is expanded. Support pole 101 may be a pole or rod and is preferably comprised of a conventionally known support tubing such as hollow aluminum or plastic tubing or alternatively any one of a variety of other flexible or inflexible material suitable for a frame structure.

As shown in FIG. 12, when the foldable frame structure 19 is fully expanded, straps 100 are taut. This creates vertical pressure on the base of support pole 101 lending internal support to canopy 24. In the preferred embodiment at least one of the straps 100 is adjustable by means of an adjustment mechanism 103. Thus the user may tighten or loosen straps increasing pressure on base of support pole 101 to raise or lower the pole. The benefit of a canopy support tension system 26 is that it is simple, light weight, and out of the way of users passing underneath.

V. CLAMPING FOOT

Figure 14:
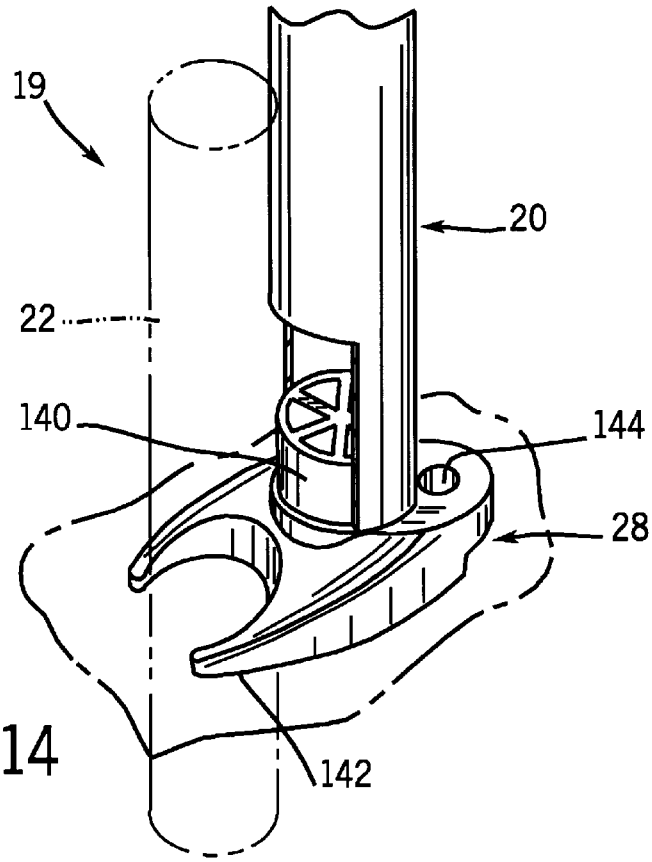
FIG. 14 is an enlarged fragmentary perspective view of the shelter of FIG. 1 with portions broken away to illustrate a detachable foot mechanism connected to the support pole.

FIG. 14 illustrates clamping foot 24. As shown in FIG. 14 clamping foot includes internal hub 140, clamping extensions 142, and stake bore 144. Internal hub 140 couples foot 24 to support pole 20. Clamping extensions 142 selectively attach foot 24 to cross pole 22 when in folded position (also shown in FIG. 10.) In addition, the wide base provided by extensions 142 provides lateral stability to prevent the support poles from tipping and additionally prevents the poles from embedding into dirt, sand, or other soft substrate. Stake bore 144 allows stake, rope or other securing device to be inserted to further secure the support pole 20 and foldable frame structure 19 to the ground or surrounding objects. Stake bore 144 allows the structure to be used on uneven ground or in adverse weather conditions.

VI. CONCLUSION

The foldable frame structure 19 provides a simplified structure, eliminates the need for a two-person set-up, and provides a lighter structure facilitating set-up, take-down, and portability. The simplified structure is accomplished by coupling cross poles 22 and support poles 20 which contain a telescopic mechanism 200, and by means of a pivotal joints 30*a*, 30*b*, 30*c*, and 30*d*. The telescopic mechanism 200 allows the poles 20 and 22 to be shortened to a fraction of their expanded length. The pivotal joints 30*a*, 30*b*, 30*c*, and 30*d* allow support poles 20 to be folded and attached to the cross poles 22. The pivotal joints 30*a*, 30*b*, 30*c*, and 30*d* additionally allow the cross poles 22 to be folded to accomplish the collapsed state. This allows the frame structure 19 to be collapsed to a fraction of its expanded size. The clamping foot 28, the pivotal joint interior tension cord 98, and the joint restriction mechanism 110 all facilitate one-person set-up, and take-down of the structure. Finally, the canopy support tension system 26 provides simplified internal support that eliminates obstructions that would otherwise restrict free movement into and out of the tent.

Although the present invention has been described with reference to preferred embodiments, workers skilled in the art will recognize that changes may be made in form and detail without departing from the spirit and scope of the invention. The present invention described with reference to the preferred embodiments as set forth in the following claims is manifestly intended to be as broad as possible. For example, unless specifically otherwise noted, the claims reciting a single particular element also encompass a plurality of such particular elements.

What is claimed is:

1. A foldable shelter, the shelter comprising:

a canopy; and a frame supporting the canopy, the frame including:

a plurality of support poles; and a plurality of cross poles, each cross pole being pivotally coupled, between adjacent support poles for rotation about an axis parallel to the support poles such that the adjacent cross poles are rotated relative to each other between a collapsed position and an opened position; wherein, the support poles are movable between a first position in which the support pole extends parallel to one of the plurality of cross poles and a second position in which the support pole extends perpendicular to said one of the plurality of cross poles.

2. The shelter of claim 1, wherein the shelter includes:

a pivotal joint coupled between adjacent cross poles, wherein the joint selectively accepts the support pole.

3. The shelter of claim 2, wherein the pivotal joint includes:

a locking mechanism coupled between at least one support pole and the pivotal joint, wherein the locking mechanism is configured to prevent pivoting of the pivotal joint from a given angle upon the acceptance of the support pole.

4. The shelter of claim 2, wherein the shelter includes:

an elastic cord coupled between the support pole and the pivotal joint.

5. The shelter of claim 1, wherein each cross pole includes:

a first section; and a second section telescopically receiving the first section to allow the cross pole to be extended.

6. The shelter of claim 5, wherein at least one cross pole includes:

a pin coupled to one of the first section and the second section; and a detent formed in the other of the first section and the second section, wherein the pin is adapted to fit into the detent to secure the first section relative to the second section.

7. The shelter of claim 6, wherein each cross pole includes:

a first surface; and a second surface, wherein the first surface is aligned to the second surface and wherein the detent is aligned with the pin to accept the pin.

8. The shelter of claim 1, wherein each support pole includes a first section; and a second section telescopically receiving the first section to allow the support pole to be extended.

9. The shelter of claim 8 wherein at least one support pole includes:

a pin and a detent, the pin adapted to lock into the detent to secure the at least one support pole in at least at one selected length.

10. The shelter of claim 8, wherein the shelter includes:

a bushing cap coupled to one of the first section and the second section.

11. The shelter of claim 8, wherein the support poles include:

a foot including extensions configured to releasably receive one of the plurality of cross poles when the support pole extends along said one of the plurality of cross poles.

12. The shelter of claim 1, including:

a detachable means for joining the canopy to the frame.

13. The shelter of claim 1, wherein the plurality of cross poles pivot to a collapsed state and wherein the plurality of cross poles, in the collapsed state, include:

a first cross pole having a first end and a second end;

a second cross pole extending substantially parallel to the first cross pole and having a first end and a second end;

a third cross pole having a first end pivotally coupled to the first end of the first cross pole and a second end pivotally coupled to the second end of the second cross pole; and a fourth cross pole crossing the third cross pole and having a first end pivotally coupled to the first end of the second pole and a second end pivotally coupled to the second end of the first pole.

14. A foldable frame for use with a canopy, the frame comprising:

a plurality of support poles; and a plurality of cross poles, wherein each support pole is movable between a collapsed state in which the support poles extend substantially parallel to the plurality of cross poles and an extended state in which the support poles extend substantially perpendicular to the plurality of cross poles and wherein each cross pole is pivotally coupled between adjacent support poles for rotation about an axis parallel to the support poles when the support poles are in the extended position, and the adjacent cross poles are rotated relative to each other between a collapsed position and an opened position.

15. The frame of claim 14, wherein the frame includes:

a pivotal joint coupled between adjacent cross poles wherein the joint selectively accepts the support pole.

16. The frame of claim 14, wherein the pivotal joint includes:

a locking mechanism configured to prevent rotation of the pivotal joint from a given angle upon the acceptance of the support pole.

17. The frame of claim 14, wherein each cross pole includes:

a first section; and a second section telescopically receiving the first section to allow the cross pole to be extended.

18. The frame of claim 17, wherein each cross pole includes:

a pin coupled to one of the first section and the second section; and a detent formed in the other of the first section and the second section, wherein the detent pin is adapted to fit into the detent pin aperture to secure the first section relative to the second section.

19. The frame of claim 18, wherein each cross pole includes:

a first surface; and a second surface, wherein the first surface is aligned to the second surface and wherein the detent is aligned with the pin to accept the pin.

20. The frame of claim 14, wherein each support pole includes:

a first section; and a second section telescopically receiving the first section to allow the support pole to be extended.

21. The frame of claim 20, wherein each support pole includes:

a pin and a detent, the pin adapted to lock into the detent to secure each support pole at least at one selected length.

22. The frame of claim 20, wherein the frame includes:

a bushing cap coupled to one of the first section and the second section, wherein the bushing cap eliminates metal on metal contact of the first and second sections.

23. The frame of claim 14, wherein at least one of the plurality of support poles includes:

a foot including extensions configured to releasably receive one of the plurality of cross poles when the at least one support pole extends along said one of the plurality of cross poles.

24. The frame of claim 14, wherein the frame includes:

at least one elastic cord coupling each support pole and each cross pole.

25. The frame of claim 14, wherein the frame includes:

means for detachably joining a canopy to the frame.

26. A method for setting up a portable shelter comprising:

providing a frame having a plurality of cross poles and a plurality of support poles in a collapsed state, wherein the plurality of cross poles includes a first cross pole having a first end and a second end, a second cross pole extending substantially parallel to the first cross pole and having a first end and a second end, a third cross pole having a first end pivotally coupled to the first end of the first cross pole and a second end pivotally coupled to the second end of the second cross pole, and a fourth cross pole crossing the third cross pole and having a first end pivotally coupled to the first end of the second cross pole and a second end pivotally coupled to the second end of the first cross pole, and wherein the plurality of support poles includes a first support pole extending substantially parallel to the first cross pole, a second support pole extending substantially parallel to the second cross pole, a third support pole extending substantially parallel to the third cross pole, and a fourth support pole extending substantially parallel to the fourth cross pole;

pivoting the plurality of cross poles to a rectangular position wherein the first and second cross poles extend parallel to one another and wherein the third and fourth cross poles extend parallel to one another; and pivoting the plurality of support poles to a supporting position, wherein each support pole extends perpendicular to the plurality of cross poles.

27. The method of claim 26 including:

telescopically extending at least two of the plurality of cross poles.

28. The method of claim 26 including:

telescopically extending each of the plurality of support poles.

29. An apparatus for supporting a canopy, the apparatus comprising:

a frame having a plurality of cross poles and a plurality of support poles in a collapsed state, wherein the plurality of cross poles include a first cross pole having a first end and a second end, a second cross pole extending substantially parallel to the first cross pole and having a first end and a second end, a third cross pole having a first end pivotally coupled to the first end of the first cross pole and a second end pivotally coupled to the second end of the second cross pole, and a fourth cross pole crossing the third cross pole and having a first end pivotally coupled to the first end of the second cross pole and a second end pivotally coupled to the second end of the first cross pole, and wherein the plurality of support poles includes a first support pole extending substantially parallel to the first cross pole, a second support pole extending substantially parallel to the second cross pole, a third support pole extending substantially parallel to the third cross pole, and a fourth support pole extending substantially parallel to the fourth cross pole, wherein the plurality of cross poles pivot to a rectangular position such that the first and second cross poles extend parallel to one another and such that the third and fourth cross poles extend parallel to one another, and wherein the plurality of support poles are movable to a supporting position such that each support pole extends perpendicular to the plurality of cross poles.

30. A foldable shelter, the shelter comprising:

a canopy; and a frame supporting the canopy, the frame including:

a plurality of support poles; and a plurality of cross poles, each cross pole being pivotally coupled between adjacent support poles for rotation about an axis parallel to the support poles, such that the adjacent cross poles are rotated relative to each other between a collapsed position and an opened position, a pivotal joint coupled between adjacent cross poles, wherein the joint selectively accepts one of the support pole;

a locking mechanism coupled between one of the support pole and the pivotal joint, wherein the locking mechanism is configured to prevent pivoting of the pivotal joint from a given angle between the adjacent cross poles upon the acceptance of the at least one support pole.

31. The foldable shelter of claim 30 wherein each cross pole includes:

a first section;

a second section telescopically receiving the first section to allow the cross pole to be extended;

a pin coupled to one of the first section and the second section; and a detent formed in the other of the first section and the second section, wherein the pin is adapted to fit into the detent to secure the first section relative to the second section.

32. The foldable shelter of claim 31 wherein each support pole includes:

a first section;

a second section telescopically receiving the first section to allow the support pole to be extended;

a pin and a detent, the pin adapted to lock into the detent to secure the at least one support pole in at least at one selected length.

33. The foldable shelter of claim 30 wherein the support poles include a foot including extensions configured to releasably receive one of the plurality of cross poles when the support pole extends along said one of the plurality of cross poles.

* * * * *